United States Patent [19]

Hasegawa

[11] Patent Number: 4,675,951

[45] Date of Patent: Jun. 30, 1987

[54] SLIDE FASTENER STRINGER

[75] Inventor: Akira Hasegawa, Kurobe, Japan

[73] Assignee: Yoshida Kogyo K. K., Tokyo, Japan

[21] Appl. No.: 910,609

[22] Filed: Sep. 23, 1986

[30] Foreign Application Priority Data

Sep. 25, 1985 [JP] Japan ..... 60-147099[U]

[51] Int. Cl.[4] ..... A44B 19/34

[52] U.S. Cl. ..... 24/408; 24/401

[58] Field of Search ..... 24/408, 401, 414, 409, 24/410; 403/265; 57/250, 257

[56] References Cited

U.S. PATENT DOCUMENTS

| | | | |
|---|---|---|---|
| 1,659,556 | 2/1928 | Bankwitz | 57/250 |
| 2,903,779 | 9/1959 | Owens | 57/250 |
| 4,250,598 | 2/1981 | Moertel | 24/408 |
| 4,290,175 | 9/1981 | Moertel | 24/408 |
| 4,331,493 | 5/1982 | Lawrence | 24/408 |
| 4,439,898 | 4/1984 | Takeshima et al. | 24/401 |
| 4,482,605 | 11/1984 | Cutts | 57/250 |
| 4,562,621 | 1/1986 | Takeshima et al. | 24/408 |

*Primary Examiner*—Victor N. Sakran

*Attorney, Agent, or Firm*—Hill, Van Santen, Steadman & Simpson

[57] ABSTRACT

A slide fastener stringer has a continuous strip of spaced thermoplastic molded coupling elements interconnected by a pair of embedded connector threads and attached to a stringer tape along a longitudinal edge thereof, each of the connector threads being covered, at its portions between adjacent coupling elements, with a thermoplastic coating integral with the coupling elements.

3 Claims, 8 Drawing Figures

SLIDE FASTENER STRINGER

BACKGROUND OF THE INVENTION

1. Field of the Invention

The present invention relates to slide fasteners, and more particularly to a slide fastener stringer having a continuous strip of thermoplastic molded coupling elements attached to a stringer tape along a longitudinal edge thereof.

2. Description of the Prior Art

Various slide fastener stringers are known in which a continuous strip of thermoplastic molded coupling elements interconnected by a pair of embedded connector threads is attached to a stringer tape along a longitudinal edge thereof. The molded coupling elements are continuously made on a die wheel having in its periphery an endless series of transverse cavities. The die wheel also has in the periphery a pair of annular grooves for receiving the connector threads intersecting the transverse cavities on opposite sides thereof. After having been bent into a U-shaped cross section, the molded coupling elements are attached to the tape by sewing stitches. However, since the only connection between the coupling elements is the connector threads, which are too flexible, only unstable attachment of the coupling elements to the tape can be achieved. This unstable attachment produces inferior slide fastener stringers with non-uniform spaces between the coupling elements. Further, it is difficult to cut such coupling element strip of a continuous length into a slide fastener length easily and precisely in the absence of a cutter of very high precision, in part because the connector threads are twisted yarns and are hence too flexible, and in part because practically a high degree of tension cannot be applied to the coupling element strip to keep the latter positionally stable during the cutting. This prior art is exemplified by U.S. Pat. No. 3,414,948.

To this end, one solution has been proposed in U.S. Pat. No. 4,290,175 (FIGS. 16 and 17) and Japanese Utility Model Post-Examination Publication No. 42-14900, for example, in which the successive coupling elements are interconnected by a pair of series of thermoplastic molded connecting portions disposed at opposite sides of the strip, each pair of the connecting portions extending between each adjacent pair of the coupling elements integrally therewith. Further, at each side of the strip, at least one connector thread is embedded in the succesive coupling elements and each series of the connecting portions and extends therethrough along the entire length of the strip. While this arrangement can solve the previous problem, a new problem is created in that an adequate degree of flexibility of the slide fastener cannot be achieved.

SUMMARY OF THE INVENTION

It is therefore an object of the present invention to provide a slide fastener stringer which has an adequate degree of flexibility and in which a row of molded coupling elements is mounted on a tape without staggered or non-uniform spaces therebetween.

According to the present invention, a slide fastener stringer has a continuous strip of spaced thermoplastic molded coupling elements interconnected by a pair of embedded connector threads and attached to a stringer tape along a longitudinal edge thereof, each of the connector threads being covered, at its portions between adjacent coupling elements, with a thermoplastic coating integral with the coupling elements.

Many other advantages, features and additional objects of the invention will become manifest to those versed in the art upon making reference to the detailed description and the accompanying drawings in which certain preferred embodiments incorporating the principles of the invention are shown by way of illustrative example.

DETAILED DESCRIPTION

Figure 1:
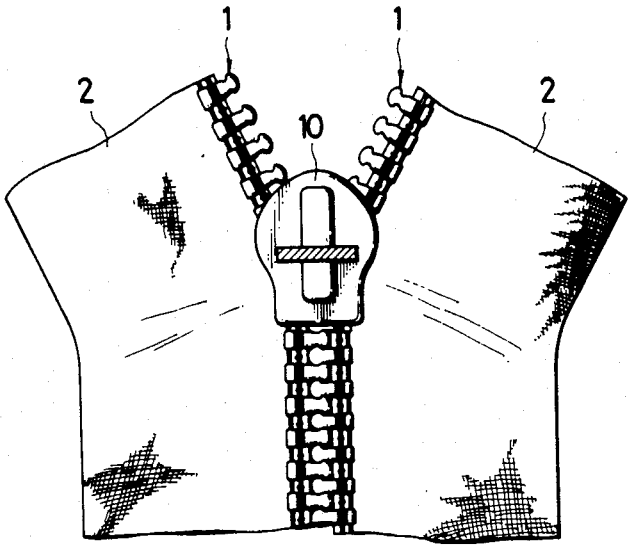
FIG. 1 is a fragmentary plan view of a slide fastener including a pair of fastener stringers each embodying the present invention.

As shown in FIG. 1, a slide fastener comprises a pair of fastener stringers each including a stringer tape 2 and a continuous thermoplastic molded coupling element strip 1 attached to the tape 2 along a longitudinal edge thereof by sewn stitches 11, 12 (FIG. 3), the strip 1 being folded on itself along its longitudinal centerline as described below. A slider 10 is slidably threaded on the opposed fastener stringers for movement therealong to close and open the slide fastener.

Figure 3:
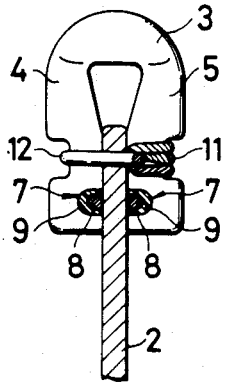
FIG. 3 is a transverse cross-sectional view of the fastener stringer of FIG. 2.

The coupling element strip 1 is continuously produced on a die wheel (not shown) having an endless ladder-shaped peripheral cavity and, before having been bent into a U-shaped cross section (FIG. 3), it has a continuous flat ladder-shaped structure. The coupling element strip 1 includes a succession of laterally spaced coupling elements 6 interconnected by a pair of first and second series of connecting portions 7, 7. Each of the coupling elements 6 has a head 3, and a first and a second leg 4, 5 initially extending from the head 3 in opposite directions. Each of the first connecting portions 7 extends between an adjacent pair of the first legs 4, 4, and each of the second connecting portions 7 extends between an adjacent pair of the second legs 5, 5. The flat strip 1 is then folded on itself along its longitudinal centerline until the first and second legs 4, 5 of each coupling element 6 are brought closely to each other so as to be directed in a common direction, as shown in FIG. 3.

Figure 5:
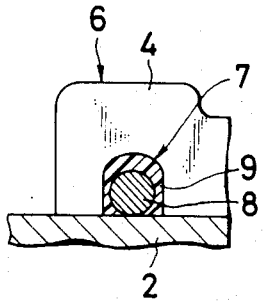
FIG. 5 is an enlarged transverse cross-sectional view showing the structure of a connecting portion between adjacent coupling elements.
Figure 6:
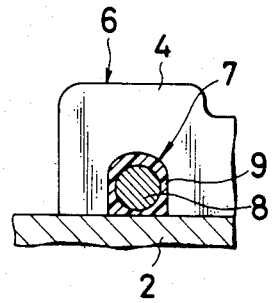
FIG. 6 is a view similar to FIG. 5, showing a modified form of the connecting portion.

The coupling element strip 1 also includes a pair of connector threads 8, 8 such as twisted yarns extending transversely of the successive coupling elements 6 along the full length of the strip 1 and embedded in the first and second legs 4, 5, respectively, of each coupling element 6 simultaneously with the molding of the strip 1. At its portions between adjacent coupling elements 6, each of the connector threads 8 is thinly covered with a thermoplastic coating 9 simultaneously with the molding of the strip 1, the coating 9 being integral with the coupling elements 6. Thus, each connecting portion 7 of the strip 1, is constituted by the twisted yarn (connector thread 8) and the thin layer of thermoplastic synthetic resin (coating 9). As shown in FIG. 3, the connector threads 8, 8 are disposed near confronting inner surfaces of the first and second legs 4, 5, respectively, of each coupling element 6 as closely as possible so that when the strip 1 is attached to the tape 2, the connector threads 8, 8 are disposed near the opposite surfaces of the tape 2 as closely as possible. FIG. 5 illustrates one example in which the surface of the tape 2 almost tangentially touches the peripheral surface of the connector thread 8, while FIG. 6 illustrates an alternative example in which the surface of the tape 2 is slightly spaced from the peripheral surface of the connector thread 8.

Figure 2:
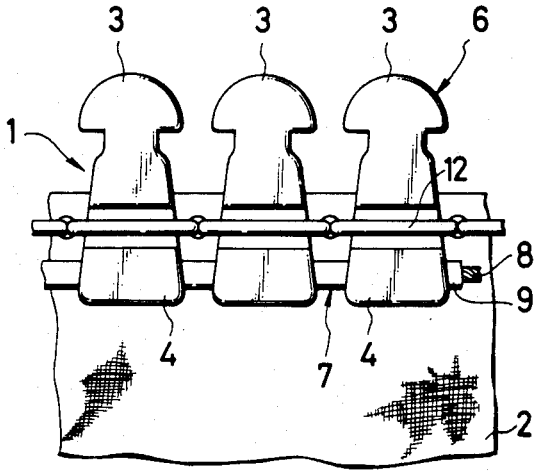
FIG. 2 is an enlarged plan view of one of the fastener stringers of FIG. 1, showing a front side of the fastener stringer.
Figure 4:
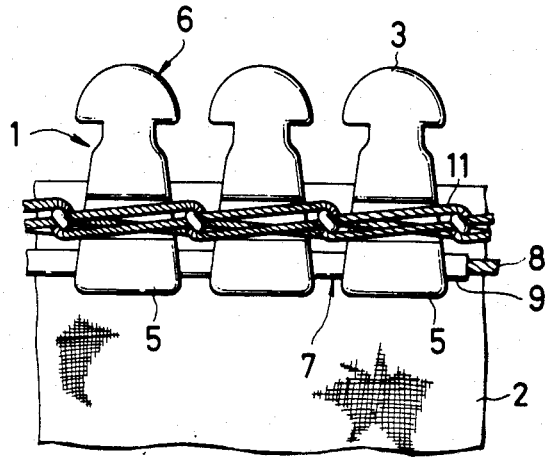
FIG.4 is a view similar to FIG. 2, showing a rear side of the fastener stringer.

The coupling element strip 1 thus produced is attached to the longitudinal edge of the stringer tape 2 by means of the sewn stitches extending transversely across the successive coupling elements 6 between the head 3 and the connecting portion 7. In the illustrative example, the type of the sewn stitches is double locked stitch which includes a needle thread 12 extending transversely over the first leg 4 of each coupling element 6 and a looper thread 11 extending transversely over the second leg 5 of each coupling element 6. The needle thread 12 has a succession of loops which are passed through the tape 2 from its front side and interlaced and interlooped with loops of the looper thread 11 on the rear side of the tape 2 as shown in FIGS. 2 and 4.

Figure 7:
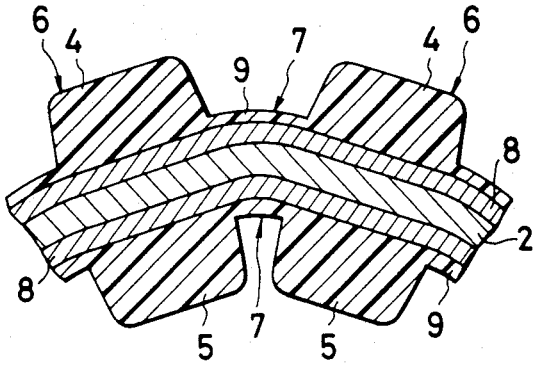
FIG. 7 is an enlarged longitudinal cross-sectional view of the fastener stringer of FIG. 2, showing the fastener stringer having been bent in a facewise direction.

Partly because the successive coupling elements 6 are interconnected by the flexible connector threads 8, 8 only thinly covered with the thermoplastic coating 9 at the connecting portions 7 between the coupling elements 6, and partly because the connector threads 8, 8 are disposed closely to the opposite surfaces of the tape 2, the resultant fastener stringer has an adequate degree of flexibility more than expected. In general, if the fastener stringer is bent facewise, i.e. in a direction perpendicular to the general plane of the tape 2 as shown in FIG. 7, the upper connector thread 8 at the individual connecting portions 7 is extended, while the lower connector thread 8 at the corresponding connecting portions 7 is contracted. Because the connector thread 8 is substantially not extendible, the more the connector threads 8, 8 are spaced from the surfaces of the tape 2, the more the flexibility of the fastener stringer is impaired. Ideally, therefore, both the upper and lower connector threads, 8, 8 are disposed in contact with the opposite surfaces of the tape 2 in order to reduce the extension and contraction to a minimum.

In the illustrated embodiment, the coupling element strip 1 is molded of nylon (tradename), and the stringer tape 2 is woven or knit of polyester yarns or mixed yarns of polyester and cotton. The lower or looper thread 11 is a multifilament yarn, and the upper or needle thread 12 is a transparent or semi-transparent monofilament.

Figure 8:
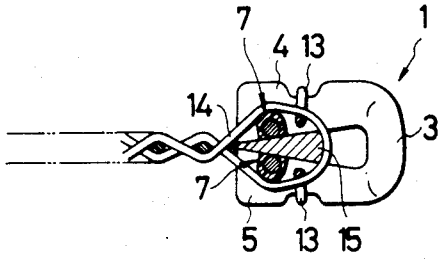
FIG. 8 is a fragmentary transverse cross-sectional view of a woven fastener stringer alternatively embodying the present invention.

FIG. 8 illustrates another embodiment in which the coupling element strip 1 is woven onto the tape 2 simultaneously with the meaning of the tape 2. A pair of upper and lower inlaid warp threads 13, 13 extends transversely over the first and second legs, respectively, of each coupling element 6 along the full length of the strip 1. A core thread 15 is inserted between the first and second legs 4, 5 of the individual coupling elements 6 and extends transversely thereof along the full length of the strip 1. The weft thread 14 of the woven tape 2 has a succession of loops encircling the connecting portions 7, 7 and the warp threads 13, 13. In this embodiment, the inlaid warp threads 13 may be transparent or semi-transparent polyester monofilaments.

According to the present invention, an adequately flexible slide fastener can be achieved, partly because the successive coupling elements are interconnected by the pair of flexible connector threads which is only thinly covered with the thermoplastic coating at the connecting portion, and partly because the connector threads are disposed near the opposite surfaces of the tape as closely as possible.

Another advantage of the present invention is that since the individual connector thread at the connecting portions is covered with the coating so as to give the connecting portions a minimum necessary degree of rigidity, proper and uniform spaces of the successive coupling elements can be maintained when the coupling element strip is attached to the tape.

Further, since the individual connecting portions are constituted by not only the twisted yarn, but the thin coating covering the twisting yarn, it is possible to cut the continuous fastener stringer into a slide fastener length easily and precisely, requiring no special cutter of very high precision.

With this arrangement, it is possible to make the fastener stringer of the type described flexible more than expected as excellently as a fastener stringer having coiled coupling elements.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A slide fastener stringer comprising:

(a) a stringer tape; and (b) a continuous thermoplastic molded coupling element strip attached to said stringer tape along one longitudinal edge thereof, said strip including (1) a succession of laterally spaced coupling elements, each having a head and a pair of first and second legs extending from said head in a common direction, and (2) a pair of connector threads interconnecting said successive coupling elements and extending transversely thereacross along the entire length of said strip and embedded in said first legs and said second legs, respectively, each of said connector threads at portions between said coupling elements being covered with a thin coating integral with said coupling elements, said connector threads being disposed near opposite surfaces of said stringer tape as closely as possible.

2. A slide fastener stringer according to claim 1, said first and second connector threads being in contact with the opposite surfaces of said stringer tape.

3. A slide fastener stringer according to claim 1, said first and second connector threads being slightly spaced from the opposite surface of said stringer tape.

* * * * *